US009840900B2

(12) United States Patent
Snider et al.

(10) Patent No.: US 9,840,900 B2
(45) Date of Patent: Dec. 12, 2017

(54) PROCESS FOR INHIBITING FLOW OF FRACTURING FLUID IN AN OFFSET WELLBORE

(71) Applicant: PETROVATIONS LLC, Fort Worth, TX (US)

(72) Inventors: Philip Martin Snider, Tomball, TX (US); David Sanford Wesson, Fort Worth, TX (US)

(73) Assignee: PETROVATIONS LLC, Fort Worth, TX (US)

( * ) Notice: Subject to any disclaimer, the term of this patent is extended or adjusted under 35 U.S.C. 154(b) by 505 days.

(21) Appl. No.: 14/604,681

(22) Filed: Jan. 24, 2015

(65) Prior Publication Data

US 2015/0211347 A1 Jul. 30, 2015

Related U.S. Application Data

(60) Provisional application No. 61/931,575, filed on Jan. 25, 2014.

(51) Int. Cl.

| | |
|---|---|
| ***E21B 43/26*** | (2006.01) |
| ***E21B 34/10*** | (2006.01) |
| ***E21B 47/06*** | (2012.01) |

(52) U.S. Cl.

CPC ..... *E21B 43/26* (2013.01); *E21B 34/10* (2013.01); *E21B 47/06* (2013.01)

(58) Field of Classification Search

CPC ..... E21B 43/26; E21B 43/261; E21B 43/267; E21B 43/28; E21B 43/283; E21B 34/10; E21B 47/06; E21B 43/17

See application file for complete search history.

(56) References Cited

U.S. PATENT DOCUMENTS 3,058,730 A * 10/1962 Bays ..... E21B 43/283 299/4

* cited by examiner

*Primary Examiner* — Wei Wang
(74) *Attorney, Agent, or Firm* — Stephen A. Gratton

(57) ABSTRACT

Processes and systems for inhibiting the flow of fracturing fluid through one or more subterranean wells offset from the subterranean well being fractured. A fracturing fluid is injected under pressure via a first well penetrating and in fluid communication with a subterranean region of interest so as to fracture the subterranean region. A second fluid is positioned within one or more second subterranean wells penetrating and in fluid communication with the subterranean region. Each second well is equipped with a standing valve that is seated by the second fluid in each second well. The pressure of the second fluid may be monitored and the pressure applied to the second fluid at the surface may be increased upon determining an increase in pressure during the monitoring step.

13 Claims, 5 Drawing Sheets

PROCESS FOR INHIBITING FLOW OF FRACTURING FLUID IN AN OFFSET WELLBORE

CROSS REFERENCE TO RELATED APPLICATION

This application claims the benefit of U.S. Provisional Application Ser. No. 61/931,575, filed Jan. 25, 2014, which is incorporated herein by reference.

BACKGROUND

The present invention relates generally to a process for inhibiting the flow of fracturing fluid through one or more subterranean wells other than the well(s) being hydraulically fractured so as to avoid hydraulic pressure and undesired wellbore fluids, such as gas and oil, in the upper well sections, including casing, tubulars, any artificial lift equipment, and surface equipment, and in one or more embodiments, to such a process wherein the flow of fracturing fluid through such subterranean wells is inhibited by pressuring fluid in the well(s) not being hydraulically fractured to seat a standing valve.

In the production of fluid from a subterranean region, a wellbore is drilled so as to penetrate one or more subterranean zone(s), horizon(s) and/or formation(s) of interest. The wellbore is typically completed by positioning casing which can be made up of tubular joints into the wellbore and securing the casing therein by any suitable means, such as cement positioned between the casing and the walls of the wellbore. Thereafter, the well is usually completed by conveying a perforating gun or other means of penetrating casing adjacent the zone(s), horizon(s) and/or formation(s) of interest and detonating explosive charges so as to perforate both the casing and the adjacent zone(s), horizon(s) and/or formation(s). A perforating gun may contain several shaped explosive charges and are available in a range of sizes and configurations which usually provide for a certain charge density and spacing of the shaped explosive charges both vertically along the wellbore and angularly about the axis of the perforating gun. In this manner, fluid communication is established between the zone(s), horizon(s) and/or formation(s) and the interior of the casing to permit the flow of fluid from the zone(s), horizon(s) and/or formation(s) into the wellbore. Alternatively, the wellbore can be completed as an "open hole", meaning that casing is installed in the wellbore but terminates above the subterranean region of interest. The well is subsequently equipped with production tubing and conventional, associated equipment, such as sliding sleeves, so as to produce fluid from the zone(s), horizon(s) and/or formation(s) of interest to the surface. The casing and/or tubing can also be used to inject fluid into the wellbore to assist in production of fluid therefrom or into the zone(s), horizon(s) and/or formation(s) to assist in extracting fluid therefrom.

It is often desirable to stimulate the subterranean region of interest to enhance production of fluids, such as hydrocarbons, therefrom by pumping fluid under pressure into the wellbore and the surrounding subterranean region of interest to induce hydraulic fracturing thereof. Thereafter, fluid may be produced from the subterranean region of interest, into the wellbore and through the production tubing and/or casing string to the surface of the earth by means of artificial lifts systems, such as a rod pump, as will be evident to a skilled artisan. Where it is desired to stimulate or fracture the subterranean region of interest at multiple, spaced apart locations along an uncased wellbore penetrating the formation, i.e. along an open hole, isolation means, such as packers, may be actuated in the open hole to isolate each particular location at which injection is to occur from the remaining locations. Thereafter fluid may be pumped under pressure from the surface into the wellbore and the subterranean region adjacent each isolated location so as to hydraulically fracture the same. The subterranean region may be hydraulically fractured simultaneously or sequentially. Conventional systems and associated methodology that are used to stimulate subterranean formation in this manner include swellable packer systems with sliding sleeves, hydraulically set packer systems, ball drop systems, and perforate and plug systems.

Often a liner is positioned and cemented within a substantial portion of an open hole, horizontal wellbore to provide greater well stability and serviceability through the horizontal section of the open hole wellbore. A "plug-and-perf" stimulation technique may be employed in such horizontal wells with cemented liners. In accordance with this technique, a plug for obtaining tubular pressure isolation, including, but not limited to a bridge plug, frac plug, or sand plug, and perforating guns may be positioned within the horizontal section near the toe (end or total depth) of the horizontal wellbore. The plug is then set and the zone is perforated by detonating the perforating gun. The plug and perforating gun are then removed from the wellbore and the fracturing fluids are pumped from the surface and diverted through the perforations into the formation by the set plug. Thereafter, another plug and associated perforating gun is lowered into the horizontal section above the previously treated portion and sequentially activated in a manner as described above. This process is repeated while typically moving from the toe (i.e., the distal end of the wellbore) to the heel (i.e., first point in a horizontal well trajectory where the inclination reaches near 90°) of the wellbore until the desired portion is the horizontal section of the wellbore is entirely stimulated, i.e. fractured.

The advent of drilling horizontal wells and hydraulically fracturing the same to improve recovery from a subterranean region, such as tight shales, has led to certain issues surrounding communication between wells. Prior to that, most wells were drilled in a generally vertical orientation and the spacing between these wells was approved by regulatory agencies and based on an assigned and generally understood drainage area. In many of low-permeability reservoirs, these wells were fractured immediately after drilling, often without any attempt to produce them before fracturing. Vertical wells were deemed spaced a sufficient distance from each other to prevent any unwanted direct fluid communication between wells during the fracturing process. The accepted theory was that vertical fractures created in adjacent wells would be parallel and not intersect each other.

Presently, horizontal wells are routinely drilled and fractured to more efficiently produce fluids from a subterranean region. However, decreased spacing requirements and the generally perpendicular orientation of fractures induced from horizontal wellbores has led to increased communication between horizontal wellbores during and after hydraulic fracturing. Invasion of fracturing fluid into well(s) other than the well(s) being fractured at a given time may result in flooding of offset(s) well and temporary loss of production. Such fluid communication may be a function of distance between wells and the fracture network present in a subterranean region, both naturally occurring and created during the fracturing process. For example, communicating wells often may be up to 3,000 feet apart, while many government agencies regulating drilling may permit horizontal wellbores with spacing as little as 500 feet from each other. Which wells will be subject to invasion of fracturing fluid during fracturing is not always readily evident to a skilled artisan due in large part to a lack of knowledge of the natural and created subterranean fracture network. While offset well communication resulting from fracturing may be temporary, in other instances such communication may be permanent and may cause direct cross-flow between wells, surface spills and damage wellbore integrity which may lead to subterranean contamination. Fluid pressure and undesired wellbore fluids, such as gas and oil, due to offset well communication may also damage well equipment, such as artificial lift equipment and surface equipment.

To inhibit the consequences of communication between offset wells during hydraulic fracturing, operators may pull equipment from the offset wells, such as pumps and rods, run a packer by means of a tubular and set the packer at a subterranean location above the subterranean region being fractured. In this manner, the offset wellbores may be sealed against the invasion of fracturing fluid communicated through the fractured subterranean region and the possible attendant problems associated therewith. However, pulling the existing equipment in a well and running and setting a packer on tubing is expensive, e.g. $300,000, and time consuming. Further, the lost production of hydrocarbons while undergoing such operation is extremely costly and may be extended by complications in setting packer(s). Accordingly, a need exists for a cost effective and efficient process for inhibiting flow of fracturing fluid into offset wells.

SUMMARY

A subterranean fracturing process comprises injecting a fracturing fluid under pressure via a first well penetrating and in fluid communication with a subterranean region of interest so as to fracture the subterranean region. A second fluid may be positioned within a second well equipped with a standing valve and penetrating and in fluid communication with the subterranean region. The second fluid seats the standing valve and inhibits flow of the fracturing fluid up the second well.

A wellbore system for fracturing a subterranean region comprises a first well penetrating and in fluid communication with a subterranean region of interest and at least one second well penetrating and in fluid communication with the subterranean region of interest, each of the at least one second well equipped with a standing valve.

A process comprises applying pressure from the surface to a fluid contained a subterranean well equipped with a standing valve and monitoring for any decline in fluid pressure that would indicate a loss of integrity of a wellbore tubular.

BRIEF DESCRIPTION OF THE DRAWINGS

Exemplary embodiments are illustrated in the referenced figures of the drawings. It is intended that the embodiments and the figures disclosed herein are to be considered illustrative rather than limiting.

DETAILED DESCRIPTION

Figure 1:
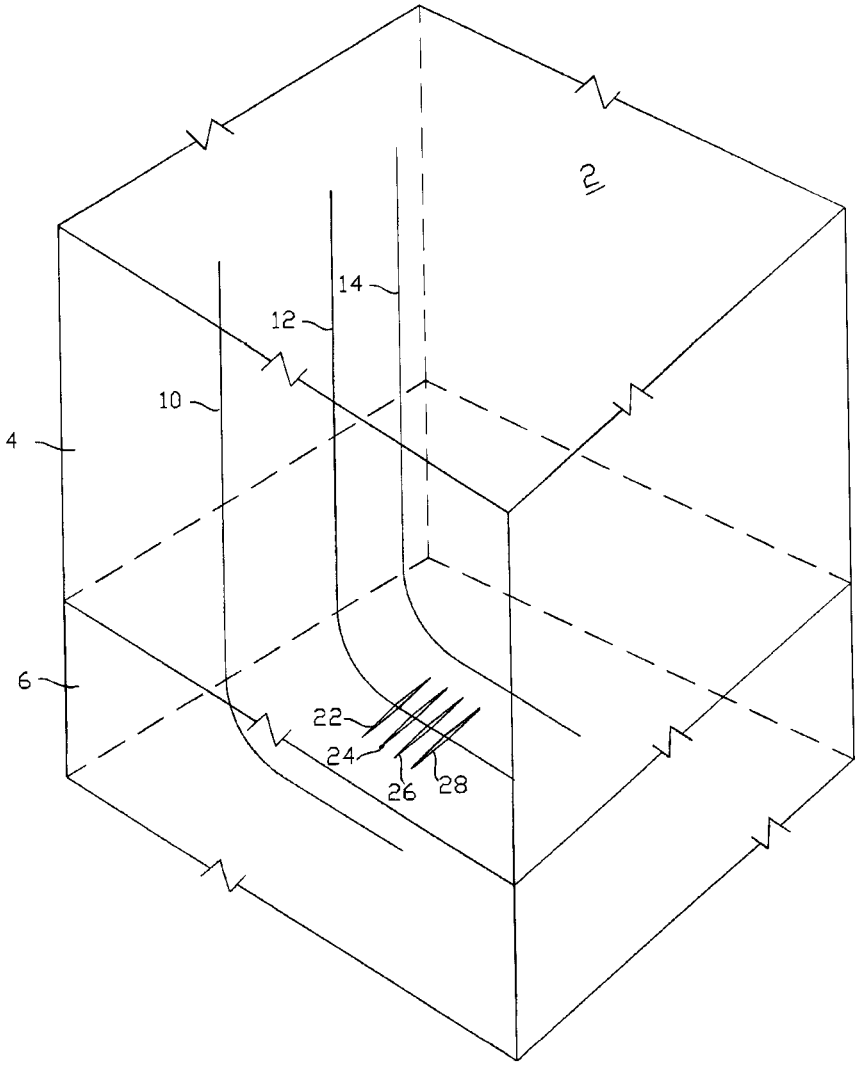
FIG. 1 is a schematic representation of a subterranean geologic volume of interest illustrating three wells penetrating and in fluid communication with a subterranean region of interest.

As used throughout this description, the term "subterranean region" denotes one or more layers, strata, zones, horizons, reservoirs, or combinations thereof, while the term "standing valve" refers to a downhole assembly, including but not limited to a valve assembly, that is designed to hold pressure from above while allowing fluids to flow from below. As illustrated in FIG. 1, wells 10, 12 and 14 are depicted as being drilled from the surface 2 through the earth 4 and penetrating and in fluid communication with a subterranean region 6 of interest. As illustrated, each well 10, 12 and 14 may have a substantially horizontal configuration through the subterranean region 6. Well 12 may be fractured at spaced apart intervals along the generally horizontal portion thereof through the subterranean region by pumping fluid from the surface of the earth into the environs 6 at sufficient pressure to create fracture networks 22, 24, 26 and 28 that extend into environs 6 away from well 12. Although not illustrated in FIG. 1, fractures 22, 24, 26 and 28 may extend to and intersect with wells 10 and 14. Also, although wells 10 and 14 are illustrated in FIG. 1 as not being fractured, one or more of these wells may have been previously fractured and fractures 22, 24, 26 and 28 may be in fluid communication with the existing fractures emanating from either or both of wells 10 and 14 (not illustrated), natural fractures within the region 6, or both. In accordance with the present invention, a process is provided for inhibiting communication into wells 10 and 14 of fracturing fluid 20 pumped into well 12 to fracture the subterranean region 6.

Figure 2:
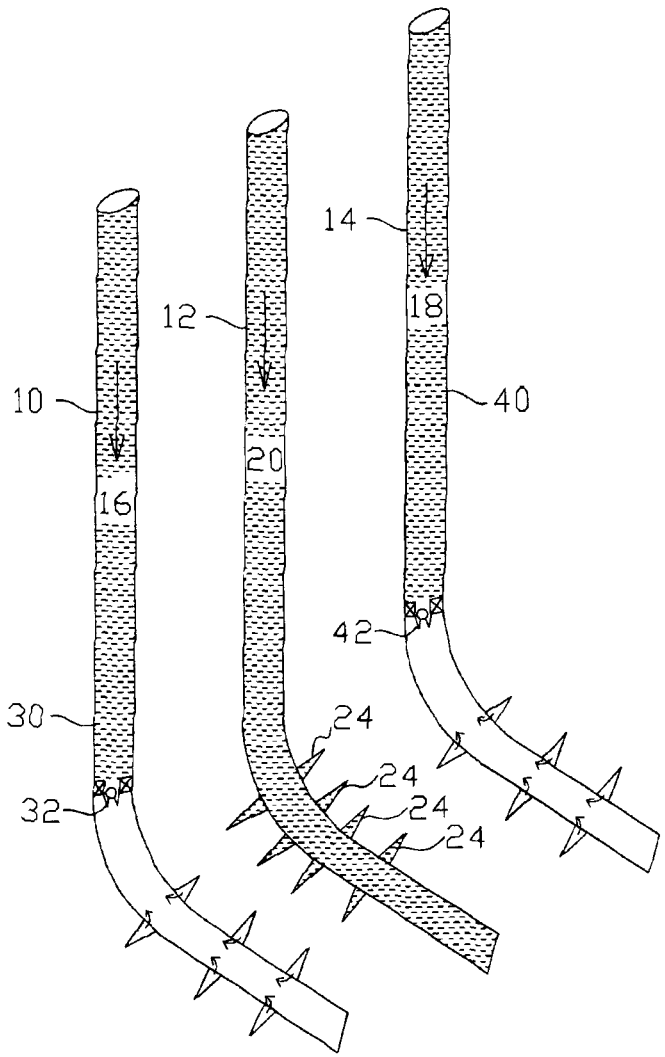
FIG. 2 is a perspective view illustrating the three wells depicted in FIG. 1 in greater detail.

In accordance with an embodiment of the process of the present invention, at least one standing valve may be positioned within at least one of the wells penetrating a subterranean region of interest that is not being fractured at the same time as well 12. As illustrated in FIG. 2, a standing valve 32 and 42 may be positioned within either or both of wells 10 well 14, respectively, and secured to a tubular, such as casing 30 and 40, respectively. As will be evident to a skilled artisan, a particular subterranean region of interest may be penetrated by a plurality of wells that may number a hundred or more and all wells in which communication of fracturing fluid from another well is desired to be inhibited may be equipped with a standing valve in accordance with the present invention. A well may be originally equipped with a standing valve that may be positioned within a corresponding profile in a tubular, such as casing (as illustrated in FIG. 2), casing liner or production tubing, or an appropriate nipple in such tubular, or included in an assembly, tool or equipment, such as a packer assembly, which the well may be originally equipped with. In the instance where such well is not originally equipped with a standing valve, the standing valve may be positioned within such a profile within a tubular within the well by any suitable means, such as slickline, in a manner evident to a skilled artisan. Alternatively, the standing valve may be included in an assembly, tool or equipment, such as a packer assembly, which is then lowered to a suitable position within the well, for example the top of a liner assembly, and secured therein. In any event, the standing valve may be positioned above the top of any perforations or sliding sleeves in the well to inhibit flow of fracturing fluid and undesired wellbore fluids, such as gas and oil, resulting therefrom entering into the well and acting upon the production casing, tubulars, surface valves, and artificial lift equipment as hereinafter described so as to prevent any damage thereto.

The standing valve may be any standing valve commercially available, such as the standing valve manufactured as part of a packer assembly by Weatherford under the trade name WR, so long as the valve will shut off fluid flow upward through the tubular when sufficient fluid pressure is applied to the valve, such as by fluid pumped through the tubular from the surface.

In accordance with an embodiment of the present invention as illustrated in FIG. 2, offset wells 10 and 14 may both be equipped with casing 30 and 40, respectively. Standing valve 32 and 42 may be set in a corresponding profile within casing 30 and 40, respectively, above the perforations formed therein. During fracturing of subterranean region 6 via well 12, suitable fluid 16 and 18 may be positioned, for example by pumping from the surface, within wells 10 and 14, respectively, to seat standing valves 32 and 42 and suitable pressure applied to the fluid 16, 18 in wells 10, 14 to ensure that fracturing fluid 20 pumped into region 6 via well 12 is not communicated through wells 10 and 14 (as indicated by the arrows in the deviated or horizontal section of wells 10 and 14 in FIG. 2) to other subterranean regions or to the surface. It will be readily understood by a skilled artisan that suitable fluids, for example produced fluids, may be already be present in one or more of the offset wells in an amount sufficient to commence the processes of the present invention without requiring fluid injection from the surface into wells 10 and 14 or in an amount that requires reduced volumes of injected or pumped fluid as opposed to those instances in which fluid is absent from the offset wells. While the suitable fluid 16, 18 used to seat the standing valves 32 and 42 may be a mud, preferably such fluid may be water, brine or high salinity brine having a relatively high density. Further, produced water, completion fluids, such as fracturing fluid, or combinations thereof may be employed as the fluid in offset well(s) that is used to seat the standing valve(s) due to their onsite availability. The pressure of the fluid 16, 18 in wells 10 and 14 must be greater than the pressure of the hydrostatic fluid in each well and the pressure of any fracturing fluid 20 communicated into wells 10 and 14 from well 12 via subterranean region (as indicated by the arrows in the deviated or horizontal section of wells 10 and 14 in FIG. 2). Fluid 16, 18 may be pumped into each well 10 and 14 at the initiation of pumping fracturing fluid 20 in well 12 and maintained during the entire fracturing operation. Fluids from subterranean region 6 may be produced via wells 10 and 14 until shortly before fracturing operations commence via well 12 to maximize production and lower the costs associated with the process of the present invention.

The density of the fluids used in offset well(s), such as wells 10 and 14, to seat the standing valve will impact the amount of surface pressure that may be applied to seat a given standing valve. In general, increasing the density of the fluid used to seat a standing valve will increase the hydrostatic pressure of the column of such fluid above and acting upon the standing valve thereby decreasing the surface pressure that may be needed to seat the standing valve. In certain instances, the density of the fracturing fluid may provide the column of such fluid acting on the standing valve with sufficient hydrostatic pressure to seat the standing valve thereby initially eliminating the need to apply further pressure on the fluid. In such instances, the fluid should be monitored to determine any increase in pressure from encroaching fracturing fluid from another well that would warrant the need to apply surface pressure to the fluid to ensure the standing valve remains seated. In addition, the standing valve may be equipped with a spring or similar mechanical device to bias the valve into the seated or closed position.

Figure 3:
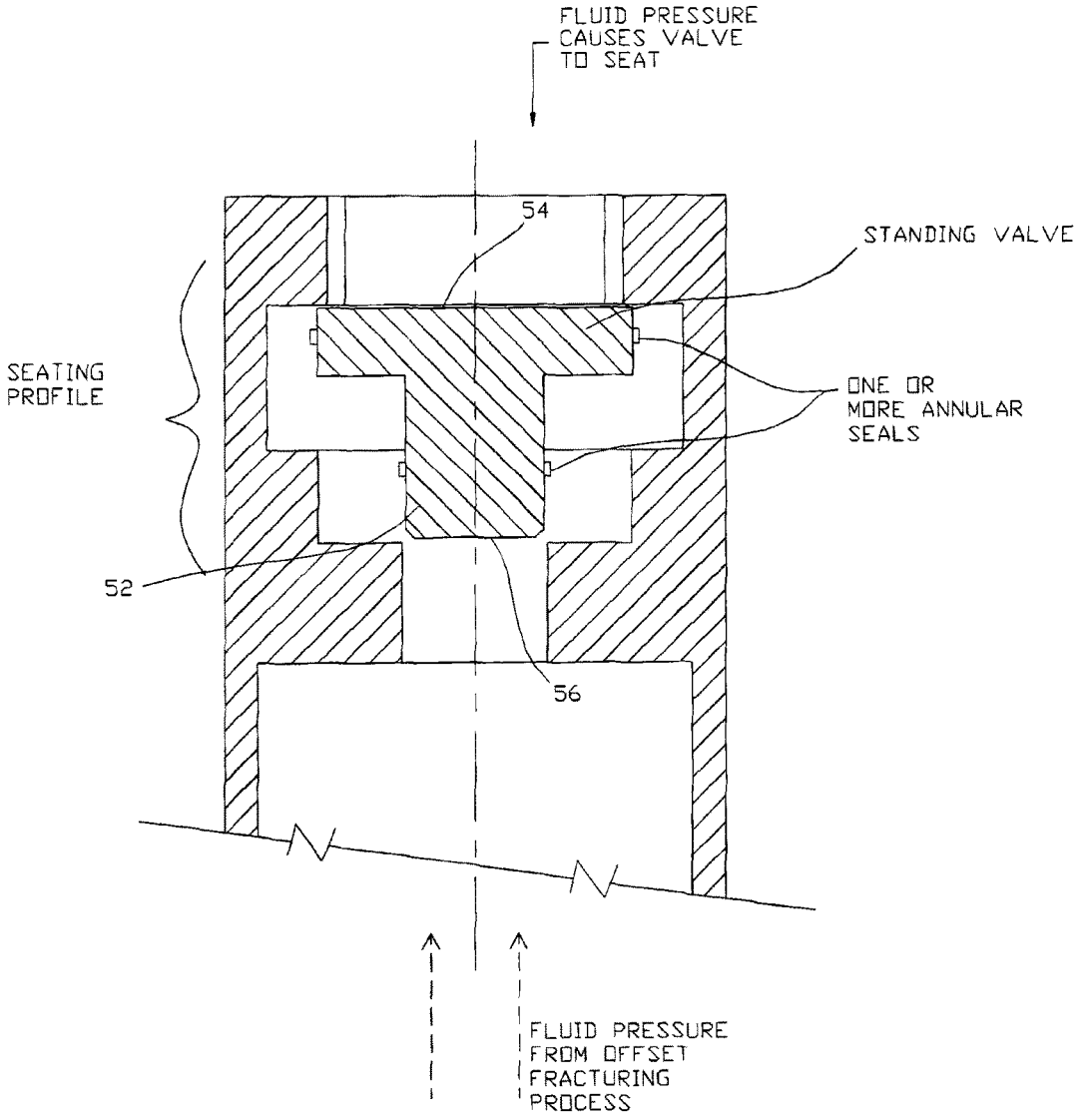
FIG. 3 is a partially cutaway, cross sectional view of one embodiment of a standing valve suitable for use in the present invention.

As wellbore pressures in excess of 8,500 psi may be encountered in offset wells during fracturing operations, it may be preferable not to pressure the fluid 16, 18 in wells 10, 14 to seat the standing valves at such high pressures to avoid any possibility of compromising the well integrity due to, for example tubular failure. Accordingly, an alternative embodiment of a standing valve is illustrated in FIG. 3. which employs a different standing valve pressure/area relationship to lower the applied surface pressure needed to seat a standing valve. Most conventional ball/seat standing valves, such as those illustrated in FIG. 2 have a substantially 1:1 pressure ratio, meaning that the surface area of the valve above the seat upon which introduced fluid acts is substantially the same as the surface area of the valve below the seat upon which encroaching fracturing fluid acts. In accordance with the embodiment illustrated in FIG. 3, the upper surface area 54 of the standing valve 52 is greater than the lower surface area 56 so that significantly less pressure may be applied to the fluid from the surface of the well to seat the standing valve 52. While the ratio of the upper surface area 54 to the lower surface area 56 may be varied, a preferred ratio of 2:1 to 3:1 may be suitable for most applications in accordance with the present invention.

In accordance with another embodiment of the present invention, a process of monitoring fluid pressure in a well comprises holding relatively low pressure on fluid 16, 18 seating the standing valve in one of more offset well 10, 14 while fracturing operations are commenced on well 12. If an increase in pressure on the fluid 16, 18 in wells 10, 14 is observed which would indicate the communication of fracturing fluid 20 into the offset well(s), then the pressure on the fluid in the affected well may be increased to ensure that the standing valve is properly seated to ensure against flow of fracturing fluid through the well. Also by including standing valves in offset wells, an operator may employ a method to insure well integrity comprising introducing fluid into the well to seat the standing valve, pressuring the fluid and monitoring any pressure decline which would indicate a loss of well integrity, such as a casing leak and "test" for the state.

The pressure of fluid 16, 18 within each well 10, 14 may be monitored by any suitable downhole pressure sensor as will be evident to a skilled artisan and the pressure of the fluid 16, 18 injected into each offset well 10, 14 adjusted to ensure that the pressure acting on the standing valve in each well is sufficient to ensure against pressure from fracturing fluid 20 unseating the standing valve and entering well 10 or 14. Alternatively, fluid 16, 18 may be pumped into one or more of wells 10, 14 when the downhole pressure sensor in such well indicates an increase due to the influx of fracturing fluid 20 during fracturing operations conducted on well 12. Suitable downhole pressure sensor technology is commercially available, for example the Spotter™ technology available from Aba Controls Inc. of Calgary, Canada.

To facilitate a better understanding of the present invention, the following example of certain aspects of some embodiments are given. The following example should not be read or construed in any manner to limit, or define, the entire scope of the invention.

EXAMPLE 1

A first well penetrates a subterranean region of interest in a substantially horizontal manner and is equipped with a plurality of sliding sleeves. The first well has a 10,000 ft. TVD (true vertical depth). The region of interest has a 0.85 psi/ft. fracture gradient. A second well penetrates and is in fluid communication with the region of interest in proximity to the first well. The second well is equipped with a ball and seat standing valve at approximately 9,500 ft. TVD. The standing valve has a 1:1 pressure ratio. Fracturing operations are commenced through at least one of the plurality of sliding sleeves in the first well. Fluid pressure beneath the standing valve in the second well is approximately 8,300 psi. A 9.6 lb/gal brine is introduced into the second well to seat the standing valve. As the hydrostatic pressure of this brine in the second well is 4,742 psi, a surface pressure at least as great as 3,500 psi is required to ensure that the standing valve remains seated during the fracturing operation thereby inhibiting flow of fracturing fluid up the second well. Recognizing that pressure from the fracturing operations on the first well may be communicated to the second well, a surface pressure of 3,500 psi is applied to the brine in the second well.

A third well penetrates and is in fluid communication with the region of interest in proximity to the first well. The third well is equipped with a ball and seat standing valve at approximately 9,500 ft. TVD. The standing valve has a 1:1 pressure ratio. As previously mentioned, fracturing operations are commenced through at least one of the plurality of sliding sleeves in the first well. Fluid pressure beneath the standing valve in the third well is approximately 8,300 psi. A 14 lb/gal brine is introduced into the third well to seat the standing valve. As the hydrostatic pressure of this brine in the third well is 6,916 psi, a surface pressure at least as great as 1,384 psi is required to ensure that the standing valve remains seated during the fracturing operation thereby inhibiting flow of fracturing fluid up the third well. Recognizing that pressure from the fracturing operations on the first well may be communicated to the third well, a surface pressure of 1,384 psi is applied to the brine in the third well.

After fracturing operations, the second and third wells are returned to production and the brine is produced to the surface and not lost to the subterranean region of interest.

While a ball and seat valve and the valve of FIG. 3 having a pressure ratio greater than 1:1 have been illustrated and described above, it is within the purview of a skilled artisan to employ any other downhole valve assembly that are designed to hold pressure from above while allowing fluids to flow from below in the present invention.

Figure 4:
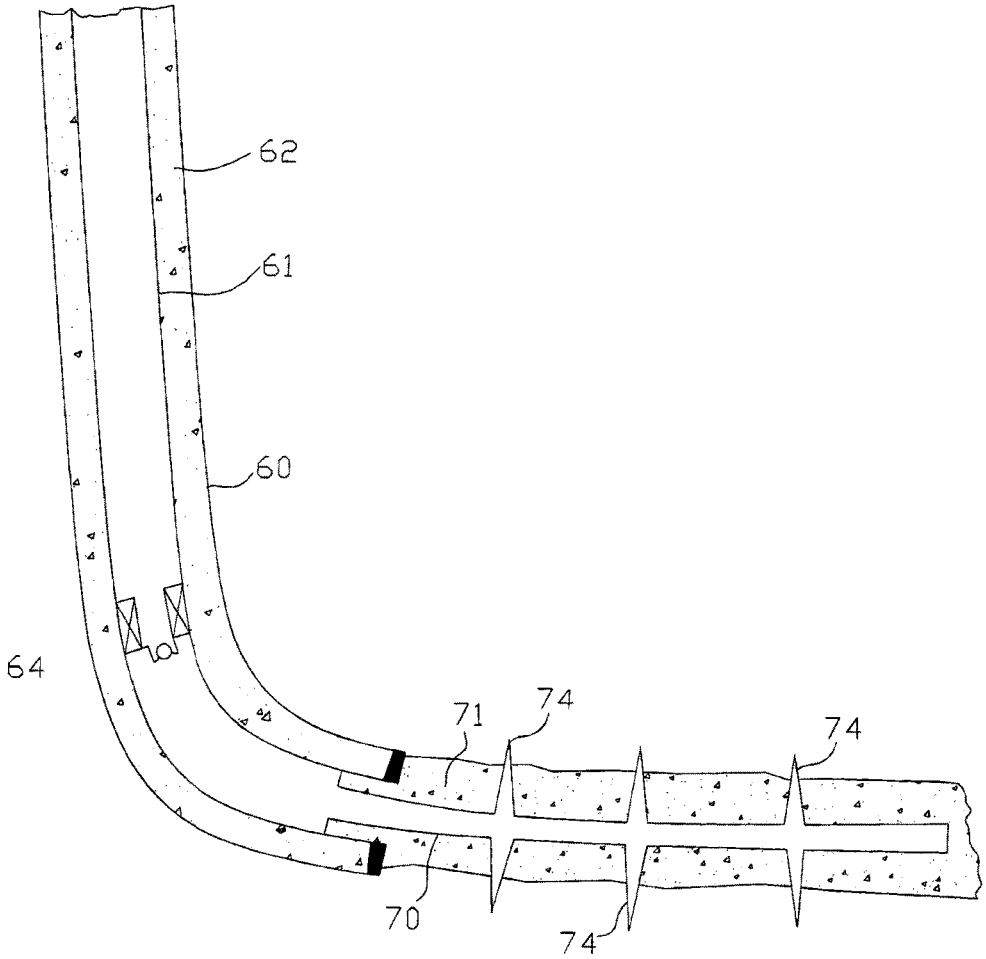
FIG. 4 is a cross sectional view of a subterranean wellbore equipped with a standing valve assembly in accordance with an embodiment of the present invention.
Figure 5:
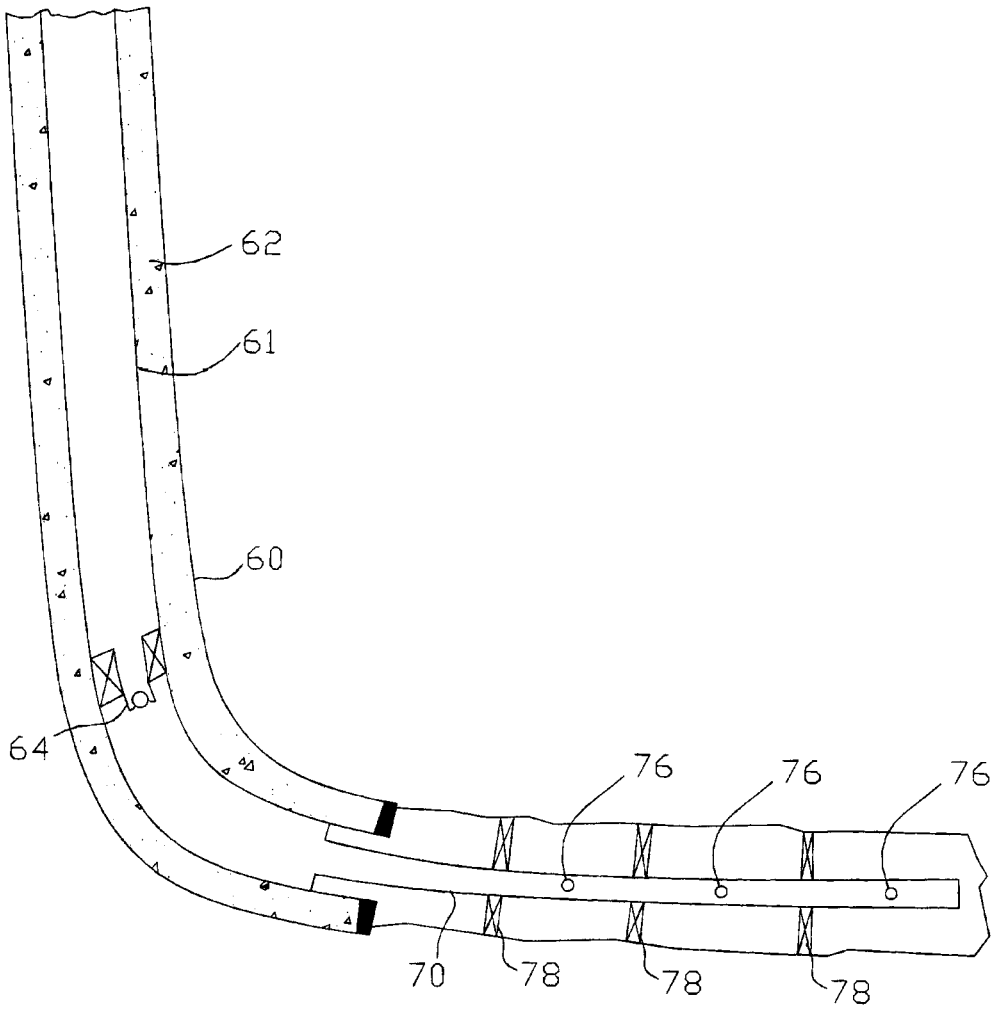
FIG. 5 is a cross sectional view of a subterranean wellbore equipped with a standing valve assembly in accordance with another embodiment of the present invention.

As previously mentioned, the standing valve assembly (i.e. an assembly including a standing valve secured to a packer) may be positioned above the top of any perforations or sliding sleeves in a given well. As will be evident to a skilled artisan, subterranean wells may be completed in different manners which will dictate the exact placement of the standing valve. As illustrated in FIG. 2, the standing valve assembly 64 is secured to a tubular, such as casing, that may be cemented within a subterranean wellbore. A rod pump and associated rods may also be positioned in the cemented casing above the packer and standing valve. Alternatively, a casing 61 that is secured within a wellbore 60 by means, such as cement 62, may terminate above or in the horizontal section and the wellbore may be equipped with a liner 70 that extends into the horizontal or deviated section of a subterranean wellbore and is secured therein by means, such as cement 71 (FIG. 4). One or more sets of perforations 74 may extend from the liner 70 through the cement 71 to establish fluid communication with region 6. The standing valve assembly 64 may be secured in a corresponding profile within casing 61 as will be evident to a skilled artisan. In another embodiment of the present invention illustrated in FIG. 5, the liner 70 is not cemented in the horizontal or deviated section of the subterranean well bore. In this embodiment, zonal isolation may be accomplished by means of sliding sleeves 76 in the liner and associated open hole packers 78 positioned on the outside of the liner 70 between the sleeves and in sealing engagement with the open hole. A rod pump and associated rods may also be positioned in the cemented casing above the standing valve assembly 64 in either of the embodiments illustrated in FIGS. 4 and 5. Alternatively, the standing valve assembly 64 may be secured in a profile in the top of the liner 70 above perforations 74 in FIG. 4 and sleeves 76 and open hole packers 78 in FIG. 5 in lieu of a profile in casing 61 as will be evident to a skilled artisan.

Certain embodiments of the methods of the invention are described herein. Additionally, although figures are provided that schematically show certain aspects of the methods of the present invention, these figures should not be viewed as limiting on any particular method of the invention. As used herein, terms such as "upper" and "lower", "upwardly" and "downwardly", "above" and "below" and other like terms indicating relative positions within a subterranean well or wellbore are used in this application to more clearly describe some embodiments of the invention. However, when applied to equipment and methods for use in subterranean wells and wellbores that are deviated from a vertical orientation, including horizontal, such terms may refer to positions within the deviated or horizontal plane, or other relationship as appropriate, rather than the vertical plane. For example, the term "above" as applied to a deviated or horizontal well or wellbore may refer to a position that is closer to the surface of the earth along the well or wellbore than the point of reference.

While a number of exemplary aspects and embodiments have been discussed above, those of skill in the art will recognize certain modifications, permutations, additions and subcombinations thereof. It is therefore intended that the following appended claims and claims hereafter introduced are interpreted to include all such modifications, permutations, additions and sub-combinations as are within their true spirit and scope.

What is claimed is:

1. A subterranean fracturing process comprising:

injecting a fracturing fluid under pressure via a first well penetrating and in fluid communication with a subterranean region of interest so as to fracture the subterranean region; and positioning a second fluid within a second well equipped with a standing valve and penetrating and in fluid communication with the subterranean region, the second fluid seating the standing valve and inhibiting flow of the fracturing fluid up the second well.

2. The subterranean fracturing process of claim 1 wherein the hydrostatic weight of the second fluid is sufficient to seat the standing valve.

3. The subterranean fracturing process of claim 2 further comprising:

monitoring the second fluid to determine any increase in surface pressure in the second well due to flow of the fracturing fluid.

4. The subterranean fracturing process of claim 3 further comprising:

increasing pressure applied to the second fluid at the surface upon determining an increase of the surface pressure during said step of monitoring to ensure the standing valve is seated.

5. The subterranean fracturing process of claim 1 wherein the second fluid is positioned within the second well by injection from the surface at a pressure deemed sufficient to seat the standing valve.

6. The subterranean fracturing process of claim 5 further comprising:

monitoring the second fluid to determine any increase in surface pressure in the second well due to flow of the fracturing fluid.

7. The subterranean fracturing process of claim 6 further comprising:

increasing pressure applied to the second fluid at the surface upon determining an increase of the surface pressure during the step of monitoring to ensure the standing valve is seated.

8. The subterranean fracturing process of claim 1 further comprising:

monitoring wellbore pressure within the second well.

9. The subterranean fracturing process of claim 8 wherein the step of positioning the fluid into the second well is initiated upon sensing an increase of the wellbore pressure during the step of monitoring.

10. The subterranean fracturing process of claim 8 wherein the pressure at which the second fluid is positioned within the second well is adjusted in response to the step of monitoring wellbore pressure.

11. The subterranean fracturing process of claim 1 wherein the step of injecting the fracturing fluid under pressure via the first well is commenced prior to the step of positioning the second fluid into the second well.

12. The subterranean fracturing process of claim 11 further comprising:

monitoring the second fluid to determine any increase in surface pressure in the second well due to flow of the fracturing fluid into the second well.

13. The subterranean fracturing process of claim 12 further comprising:

increasing pressure applied to the second fluid at the surface upon determining an increase of the surface pressure during said step of monitoring to ensure the standing valve is seated.

* * * * *